US009362024B2

(12) United States Patent
Simenhaus et al.

(10) Patent No.: US 9,362,024 B2
(45) Date of Patent: Jun. 7, 2016

(54) HIGH VOLTAGE TRANSMISSION LINE CABLE BASED ON TEXTILE COMPOSITE MATERIAL

(71) Applicants: Zidkiyahu Simenhaus, Galil Elyon (IL); Vladimir N. Filatov, Moscow (RU)

(72) Inventors: Zidkiyahu Simenhaus, Galil Elyon (IL); Vladimir N. Filatov, Moscow (RU)

( * ) Notice: Subject to any disclaimer, the term of this patent is extended or adjusted under 35 U.S.C. 154(b) by 350 days.

(21) Appl. No.: 14/139,515

(22) Filed: Dec. 23, 2013

(65) Prior Publication Data

US 2014/0182880 A1 Jul. 3, 2014

(30) Foreign Application Priority Data

Dec. 27, 2012 (IL) ..... 223937

(51) Int. Cl.

| | |
|---|---|
| ***H01B 3/08*** | (2006.01) |
| ***H01B 7/29*** | (2006.01) |
| ***H01B 3/50*** | (2006.01) |
| ***D07B 1/16*** | (2006.01) |
| ***H01B 1/18*** | (2006.01) |
| ***H01B 5/10*** | (2006.01) |
| ***D07B 1/14*** | (2006.01) |
| *H01B 7/18* | (2006.01) |

(52) U.S. Cl.

CPC *H01B 7/29* (2013.01); *D07B 1/147* (2013.01); *D07B 1/162* (2013.01); *H01B 1/18* (2013.01); *H01B 3/08* (2013.01); *H01B 3/50* (2013.01); *H01B 5/105* (2013.01); *H01B 7/292* (2013.01); *H01B 7/1825* (2013.01)

(58) Field of Classification Search

USPC ..... 174/102 C

See application file for complete search history.

(56) References Cited

U.S. PATENT DOCUMENTS

| | | | | |
|---|---|---|---|---|
| 2,057,431 | A | 10/1936 | Hobrock | |
| 2,487,581 | A | 11/1949 | Palumbo | |
| 2,556,616 | A | 6/1951 | Ellis | |
| 3,683,309 | A | 8/1972 | Hirose | |
| 4,435,692 | A * | 3/1984 | Miyamoto | H01B 7/0063 174/120 SC |
| 4,748,436 | A | 5/1988 | Kanamori et al. | |
| 4,800,359 | A * | 1/1989 | Yukawa | H01C 3/20 338/214 |
| 4,970,488 | A * | 11/1990 | Horiike | H01B 7/0063 174/102 SC |
| 5,576,514 | A * | 11/1996 | Fujimoto | H01B 7/0063 174/110 FC |
| 5,824,958 | A * | 10/1998 | Higashikozono | H01B 7/0063 174/105 R |
| 5,876,790 | A | 3/1999 | Kats | |
| 2005/0205287 | A1 | 9/2005 | Browning et al. | |
| 2012/0070122 | A1 * | 3/2012 | Lind | F03D 5/00 385/103 |

FOREIGN PATENT DOCUMENTS

| | | | |
|---|---|---|---|
| DE | 3744545 | A1 | 7/1989 |
| EP | 0020799 | A1 | 1/1981 |
| EP | 0460507 | A1 | 12/1991 |
| EP | 0628706 | A2 | 12/1994 |
| EP | 1211395 | A1 | 6/2002 |
| EP | 1248749 | B1 | 6/2005 |

(Continued)

*Primary Examiner* — Timothy Thompson
*Assistant Examiner* — Krystal Robinson
(74) *Attorney, Agent, or Firm* — David B. Tingey; Kirton McConkie

(57) ABSTRACT

An electric transmission cable having a current conductive element comprising a braided core formed of a plurality of high modulus synthetic armored yarns, each yarn being of at least 53.6 tex and having a tensile strength of at least 200 cN/tex (centiNewton/tex), and the core being of a diameter in the range of 0.7 mm to 4.5 mm and being surrounded by a quartz sleeve covered on an outer surface thereof by a carbon layer.

15 Claims, 2 Drawing Sheets

(56) References Cited

FOREIGN PATENT DOCUMENTS

| | | | |
|---|---|---|---|
| RU | 2145452 | C1 | 12/1994 |
| WO | WO 00/11328 | A1 | 3/2000 |
| WO | WO 00/67528 | A1 | 11/2000 |
| WO | WO 00/71867 | A1 | 11/2000 |
| WO | WO 01/47825 | A1 | 7/2001 |
| WO | WO 02/31325 | A1 | 4/2002 |
| WO | WO 03/091008 | A1 | 11/2003 |
| WO | WO 2011/008568 | A2 | 11/2011 |

* cited by examiner

HIGH VOLTAGE TRANSMISSION LINE CABLE BASED ON TEXTILE COMPOSITE MATERIAL

RELATED APPLICATIONS

This application claims priority to Israeli Patent Application Serial No. IL 223937 filed Dec. 27, 2012, which is incorporated herein by reference.

BACKGROUND OF THE INVENTION

1. Field of the Invention

The invention relates to high voltage cables having current-conductive-elements (CCE) made of a textile composite material, coated with nano-carbonaceous particles.

2. Background and Related Art

A variety of ways to coat surfaces of non-metallic substances (e.g., glass, ceramics, quartz, etc.) with a carbon compound layer are well known in the art.

U.S. Pat. No. 2,556,616 for example, teaches a method to deposit a carbon coating by thermally decomposing an organic material to form carbon as a solid decomposition product, where such decomposing is usually effected within a porous body, after the body has been impregnated with a suitable organic material. This technique is often used as the basis for manufacturing solid body carbon resistors.

Alternatively, US has relatively low adhesiveness and thus must be physically protected. Moreover, the U.S. Pat. Nos. 2,057,431 and 2,487,581 teach that the material decomposed may be a hydrocarbon gas contained in a gaseous atmosphere surrounding a body. In this case the body serves as a substrate, and the carbon is deposited within pores or on the surface depending upon the nature of the substrate body. Where a smooth surface is employed, this procedure is the basis of carbon coated resistors. As a general rule, carbon deposited after thermal decomposition is in particulate form, use of gaseous hydrocarbon atmosphere requires considerable care, and is frequently considered to be impractical as an industrial production method.

C60 thin films have a high degree of crystalline texture. The process of impregnating C60 thin films on metal substrates, in particular onto glass substrates coated with silver or gold, by using vacuum evaporation with a high deposition rate maintained at high temperature, is well known in the art.

A known method according to U.S. Pat. No. 5,876,790 uses a vacuum evaporation system wherein a metal substrate is operated at a high temperature during deposition of C60 onto the substrate. The C60 thin films are used as active layers in electronic devices like transistors, photo-voltaic cells, solar cells, integrated circuits, sensors, and light emission devices, devices for electro-photography, magnetic recording discs and superconductors.

It should be noted that the possibility of a spontaneous carbon condensing arising in vapor of such substance was demonstrated by Robert F. Curl, Richard E. Smalley and Harry Kroto. It should be noted that, practically, it is difficult to separate fullerenes from other products. However Kratchmer and Hoffmann showed that C60 molecules may exist in a sufficiently large quantity as clusters having an even number of carbon atoms greater than 32. Molecules of this substance are absolutely stable. Accordingly the durability of the carbon layer(s) is increased and its/their parameters are improved.

Electro-conductive-textiles-elements having a carbon coating are known in the art.

WO 00/67528 describes a textile-fiberglass based conducting element and a production method thereof. This fiberglass material is coated with carbon (0.2%-1.5% w/w) in the form of a turbo-strata structure. It features, at least, 650° C. after-tack temperature. The method calls for passing a single glass fiber (not fiber harness) through specially selected carbon-contained vapor, of industrial, motors, transformer and vacuum oils. The carbon layer is deposited upon the fiber by a pyrolysis process with subsequent vacuum degassing at 350° C.-450° C.

DE 3744545 corresponding to U.S. Pat. No. 4,800,359 describes a method of producing conducting textiles, which are used as a core of ignition cables. It teaches a technique where the core glass or armored fibers are braided or bound like a grapevine. The core is encased into an acryl-polybutene-styrene cover and a layer of elastomeric plastic(s) is applied with a coiled nickel or a nickel-chromium spiral having a diameter of 0.035-0.065 mm over it.

A disadvantage of this method derives from the impossibility to produce a current-conducting Element (CCE) having a preset electrical resistance value and, the resulting CCE has a low tensile strength and a low breaking point.

A method of producing current-conducting textiles is described in U.S. Pat. No. 3,683,309. The method teaches to apply a layer of resin with metal, oxides, silicates, soot and graphite dispersed therein upon a non-metallic core made of fiberglass. In order to reduce the side effects of the "high frequency noise", the current-conductive-element (CCE) is covered with a vulcanized caoutchouc coating.

Products manufactured by such a method suffer from the following disadvantages. The carbon coating layer, applied onto the cable body in order to create a CCE is uneven and coarse resulting in "upper current" generation that breaks down the cable's cover. It is also impossible to produce a CCE having a preset electrical resistance value and a high breaking strength point.

U.S. Pat. No. 4,748,436 describes a method for producing a CCE—an ignition cable made of fiberglass. The method teaches applying carbon upon the fiberglass core via a cracking process, executed in the presence of catalysts, while passing through a chamber-station which contains vapor compounds. This method is very complicated technologically and it does not allow producing a CCE with a preset electrical resistance value.

Furthermore, as a general rule, carbon deposited after thermal decomposition is in particulate form, has relatively low adhesiveness and therefore must be physically protected. Moreover, the use of a gaseous hydrocarbon atmosphere requires considerable care, and is frequently considered to be impractical as an industrial method.

WO 01/47825 presents a method of manufacturing a textile current-conductive element of braided quartz fibers, impregnated with peat, by passing the braided quartz rope through a basin, which contains a boiling solution of peat extracted in xylol, then drawing it out via a hot furnace heated between 600° C. to 1100° C. so that each filament is covered with a thin layer of carbon in the form of molecular cages or fullerenes. This method allows current-conducting elements having preset electrical resistance values to be produced.

However, a disadvantage of this method derives from the fact that the element possesses insufficient flexing and has a low tensile strength. These features sharply decrease manufacturability and aggravate the production process.

As mentioned above, the products according to WO 01/47825 A1 possess inadequate tensile strength and insufficient flexibility that cause the cable to fracture very often during the process of drawing on the cable, which is done by applying force to an end of the cable.

The present Applicants made CCEs according to the techniques described in WO 01/47825. We hardly ever managed to produce such CCEs of 100 meter length. Even when using a slow velocity production process, which ranged from 0.05 meter/Min. up to 0.9 meter/Min., the CCEs we achieved were of 70-50 meter respectively with no fracture of the cable. But at a speed of 1.0 m/Min-3.0 m/Min. (maximum) we were able to produce CCEs of 45 meter-32 meter with no dielectric breakdowns. It is obvious that the abovementioned CCEs lack sufficient tensile strength.

Furthermore, upon occurrence of such fractures one is forced to stop the manufacturing process to clean the furnace and insert a new quartz rope and to restart the carbon coating process.

Moreover, because of its insufficient (low) tensile strength, if it is required to coat the rope with any metal, the impregnation of a metal-cover over it could be hardly done, even when the cable is drawn at a low speed, and because of cable fracture it will be imperative to clean the impregnating appliance, to insert a new CCE and to start the coating process again.

Additionally, it should be noted that, by and large, the reasonable required length of a current-conducting element for passing through a technological cycle of industrial commercial known mechanism, just to apply a carbonaceous cover over the quartz sleeve (substrate), and/or coating it with a metal cover, and/or braiding or inserting a protecting-isolating cover over it is, at least, 10,000 M length with no breaking down.

As a result of the abovementioned malfunction, elements manufactured according to the methods disclosed in WO 01/47825 are ineffective even useless for large production batches. It might be adequate for small batches production only, and the resulting products are suitable for only limited industrial uses and scientific experiments.

Moreover, the CCEs or the cables produced as described in WO 01/47825 do not provide sufficient protection against noise. Consequently, computers and radio communication are frequently disturbed.

Furthermore, when CCEs are made by applying a dispersed mixture of carbon upon the conducting element, their conductive construction elements undergo, under time, a polymerization process, which renders the structure "sintered" to such extent that its electro-conductivity property is altered or even completely disappears. Cables constructed according to WO 01/47825 typically remain conductive for not more than one year.

Metallic Coating

Various types of catalysts, known in the art are used to burn up exhaust gases of the ICE, i.e. to perform a catalytic transformation of nitrogen oxides and hydrocarbons into nitrogen and carbon dioxide, friendly to the environment.

By using well known techniques, the conductive elements, which are the basis for the construction of the catalysts, are coated with metals mainly of the platinoid group.

For example, EP 0020799 describes a catalyst having particles of —Pt, Rh— metals, which belongs to the $8^{th}$ group of the Periodic Table, deposited upon zeolite Y. EP 0628706 describes a catalyst in the form of PVC containing Ni and Ag. This application, which describes a $NO_2$ electro-catalytic, indicates the possibility of recovery of one of the several exhaust gases component —Ag, which is deposited upon ceramic header in the presence of solid electrolyte(s): $Zr0_2$: $HJO_2$:$TiO_2$ (also see "Proc. Intersoc. Energy Conversion., Eng. Conf., 27 vol. 4, p. 4, 321-4, 325, 1992).

EP 0460507 proposes a catalyst with copper deposited upon zeolite, targeted to burn up exhaust gases.

In WO 02/31325 a catalyst presenting a mixture of metals Pt, Rh, Pd deposited upon zeolite.

WO 00/11328 describes a catalyst with Pt, Rh, Pd deposited upon ceramic substrata in the form of a "comb" with perforations.

In WO 00/71867 Pt, Rh, Pd are used to burn up exhaust gases with subsequent exposure to plasma and UV light.

EP 1211395 discloses a catalyst containing Pt, Rh, Pd, and small quantity of $CeO_2$— as the source of Oxygen.

Furthermore, all the aforementioned publications disclose Current-Conducting Elements and not high-voltage long distance transmission cables.

SUMMARY OF THE INVENTION

An object of the present invention is to provide improved textile-carbon current-conductive-elements (CCEs) and new high voltage cables, for various uses.

This object is realized in accordance with the invention by electric transmission cable having a current conductive element comprising a braided core formed of a plurality of high modulus synthetic armored yarns, each yarn being of at least 53.6 tex and having a tensile strength of at least 200 cN/tex (centiNewton/tex), and the core being of a diameter in the range of 0.7 mm to 4.5 mm and being surrounded by a quartz sleeve covered on an outer surface thereof by a carbon layer.

When used in this document and the appended claims, the term carbonaceous or carbon is used to designate both carbon as well as a compound formed of hydrocarbons.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF THE INVENTION

In the following description of some embodiments, identical components that appear in more than one figure or that share similar functionality will be referenced by identical reference symbols.

Figure 1:
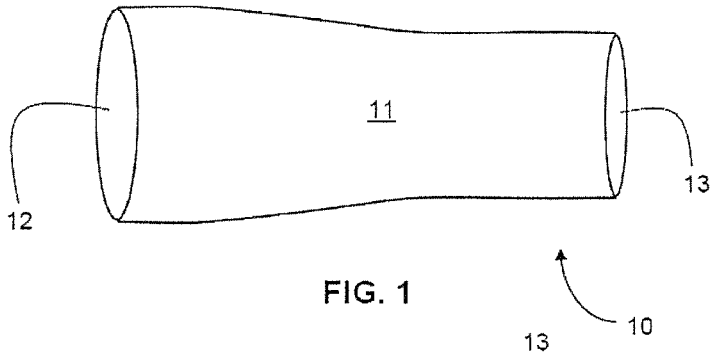
FIG. 1 shows schematically a cylindrical metallic alloy for use in a continuous carbonization production process.

FIG. 1 shows schematically a cylindrical metallic alloy 10 for use in a continuous carbonization production process according to the invention. The cylindrical metallic alloy 10 has a body portion 11, an entrance aperture 12 and an exit aperture 13.

Figure 2:
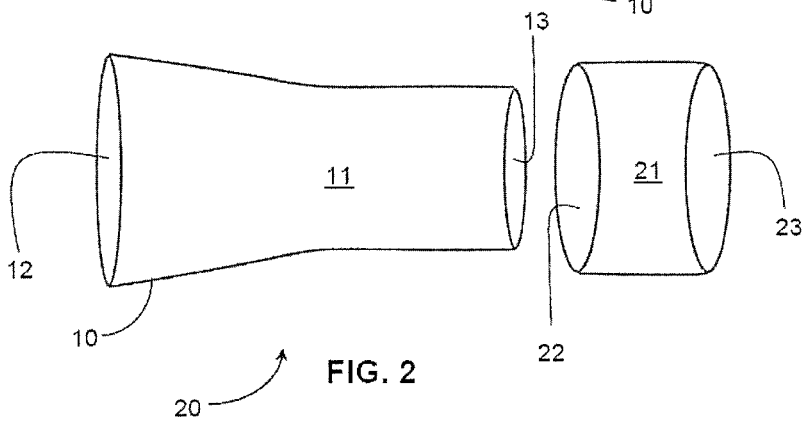
FIG. 2 shows schematically an alternative cylindrical metallic alloy formed of two units for use in a two-step carbonization production process.

FIG. 2 shows schematically an alternative cylindrical metallic alloy 20 formed of a first unit 10 and a second unit 21 for use in a two-step carbonization production process. The first unit is the same as the cylindrical metallic alloy 10 shown in FIG. 1 having a body portion 11, an entrance aperture 12 and an exit aperture 13. The second unit 20 has a body portion 21, an entrance aperture 22 and an exit aperture 23.

Figure 3:
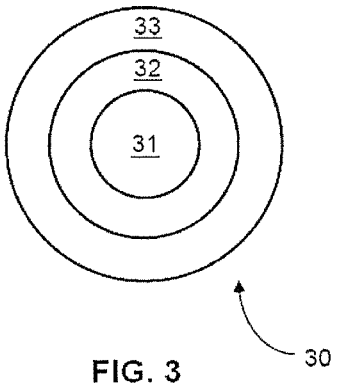
FIG. 3 shows schematically a CCE according to an embodiment of the invention.

FIG. 3 shows schematically a CCE 30 according to an embodiment of the invention having a core 31 e.g., a Kevlar rope, a substrate 32, which may be a braided quartz sleeve and a carbon coating 33.

Figure 4:
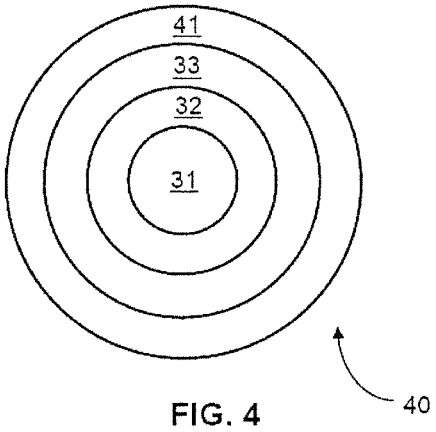
FIG. 4 shows schematically a basic cable based on one CCE.

FIG. 4 shows schematically a basic cable 40 based on a single CCE 30 as shown in FIG. 3 and having an outer protection cover 41.

Figure 5:
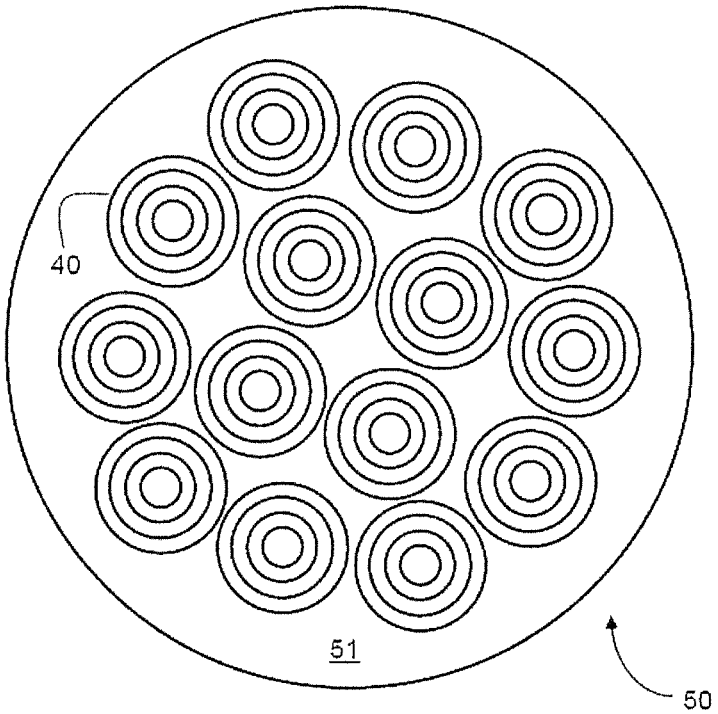
FIG. 5 shows schematically a high voltage transmission cable comprising multiple basic cables as shown in FIG. 4.

FIG. 5 shows schematically a high voltage transmission cable 50 comprising multiple basic cables 40 as shown in FIG. 4 contained within an outer protection cover 51.

Figure 6:
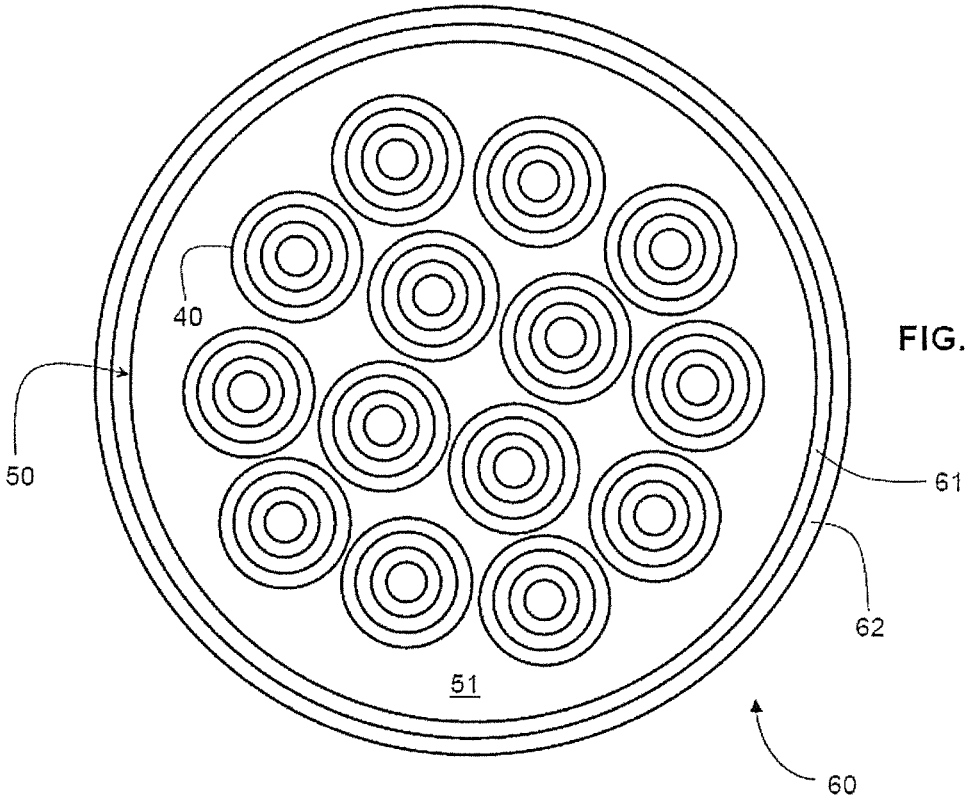
FIG. 6 shows schematically a high voltage transmission submarine cable having two outer protection covers, for use under water on the sea bed.

FIG. 6 shows schematically a high voltage transmission submarine cable 60 comprising the cable 50 shown in FIG. 5 but having two outer protection covers 61 and 62, for use for example under water on the sea bed.

Further details of the components and the cables shown in the figures are presented below.

A high-voltage cable according to the invention has a Current-Conductive-Element(s) (CCE) formed of Textile Composite Materials. The current-conductive-element comprises a central core made of a synthetic high modulus yarn(s) of aramid surrounded by a sleeve-cover of braided yarns made of multilayer quartz fibers ("Substrate"); and coated with nano-carbonaceous particles forming one or more carbon layers. The CCE, which is covered with an insulating protective coat having a thickness of 1 mm-5 mm, has a wide range of properties such as adjustable resistance, waterproof, preset properties, and relatively elevated mechanical qualities of high tensile strength, high bending flexibility and a high breaking point; and, withstands a wide range of temperatures that varies from −196° C. up to +1200° C.

The Current-Conductive-Elements (CCEs) according to the invention can be used in the electric engineering industries, the satellite and the motor industries for the following uses as specified hereto:

- CCE of Long Distance Supper High-Voltage Transmission Lines.
- CCE of High-Voltage Cables Transmission Lines.
- CCEs of Electric cables.
- Substrates for: non-metallic conductors, semi-conductors and electronic devices.
- Noise suppressing (high-voltage) wire(s).
- Ignition cables for internal combustion engines and vehicle exhaust gas catalysts for a catalytic transformation of nitrogen oxide and hydrocarbons, contained therein, to nitrogen and carbon dioxide friendly to the environment.
- Heating element(s).

The High-Voltage Cables are formed by a group of several protective Current-Conductive-Elements (CCEs), e.g., 2 to 50 CCEs and even more, gathered into a bunch so as to meet transmission requirement. The proposed cables are insulated with an outer sleeve cover that also serves as a protection and is made, in some embodiments, of a multilayer braided quartz fibers cover and/or silicon or polyethylene; or of polypropylene-carbon composites or, silicon-carbon composite or, a similar equivalent having a width of between 2.5 mm-10 mm to meet requirements of protection, water proofing, tensile strength and flexing.

Method of Manufacturing the High-Voltage Cable

The Current-Conductive-Element (CCE)

The central inner core of the proposed CCE is a braided rope of 1 mm diameter made of 8 (eight) synthetic high-modulus aramid yarns, such as Kevlar (or any equivalent substitutes, e.g., Twaron, Nomex, RUSAR, or SHMF) of 58.8 tex each having a tensile strength of at least 200 cN/tex.

In preferred embodiment, in order to strengthen the total tensile strength capability of the CCE, and thereby subsequently strengthen the high-voltage transmission cable(s), the central inner core of the CCE is made of twelve or more such synthetic high-modulus yarns of aramid in order to yield a core diameter up to 4.5 mm.

The central inner aramid (e.g. Kevlar) core is braided on a ShP-12-4 (or, e.g. IIIII-12-4) braiding machine having an exit diameter of 1 mm (it could be also braided on any other braiding machine having an exit diameter of 1 mm). The achieved braided aramid (e.g. Kevlar) rope functions as the core ("Core") of the CCE.

The obtained Kevlar central cord is inserted into a ShP-SVM-1 braiding-sleeve-rope machine having an outer exit diameter of 1.5 mm (or, e.g., a IIIII-CBM-1 braiding machine and/or any other braiding machine having an equivalent outer diameter exit) and should be entirely covered with a braided sleeve-coat made of quartz fibers ("Quartz Coat" or "Quartz Sleeve").

The quartz coat, is braided out of a multi-filament quartz, i.e. silicon oxide, yarns which belongs to the $8^{th}$ group of the Periodic Table, e.g., of 17×4×1 (68 tex) having a melting point of at least 1,680° C.; preferably 1,730° C. Consequently, the thickness of the quartz sleeve's protective "wall" around the core will be of 0.25 mm such that the total diameter of the obtained rope is 1.5 mm. The obtained Kevlar-Quartz rope ("Substrate") which has thermo-resistance properties of withstanding a wide range of temperatures varying from −196° C. up to +1730° C., will serve as a substrate carrier for the carbonaceous layer(s) and afterwards considerably for various metal(s), coated onto as described hereto.

It should be noted that in order to obtain a Kevlar-Quartz rope ("Cord") of a total diameter of 2.0 mm the multi-filament quartz fibers should be selected and the outer exit of the braiding machine should be adjusted to substantially 2.0 mm. The same applies to a 3.5 mm or 5.0 mm substrate.

It should be noted that the obtained substrate's elevated mechanical properties derives from its specific raw materials and its braided configuration. The high tensile strength and the relatively high flexibility and high breaking point are the result of the Kevlar's unique qualities, or of the equivalent substitutes. 'Its ability to withstand a wide range of temperatures, varying from −196° C. up to +1200° C., as noted previously, is derived from the quartz yarn' having a melting point of at least 1,680° C. and in preferred embodiments 1,730° C.

The abovementioned properties are basic standard requirements so as to enable continuous industrial manufacturing processes of ECCs and consequently long distance cables for industrial commercial uses as described above.

In order to add the electric-conductivity properties to the obtained substrate, it is passed through a furnace ("Pyrolysis chamber" and/or "Kiln") heated at 600° C.-1200° C. The pyrolysis chamber contains an immersion basin and a thereto-resistance metallic tube alloy, which is situated horizontally inside the pyrolysis chamber. The substrate is inserted into the immersion basin, which contains a solution of organic compounds—a hydrocarbon(s) solution, at a mass concentration of 3%-12%, which is obtained by using peat, or crude oil, benzol, or toluene, and/or combination thereof extracted by xylol, or any similar solvent.

In order to achieve a carbon mass impregnation of at least 10% w/w preferably 15% w/w, the substrate, after the inner-threads space is filled with the hydrocarbon(s) solution, it is pulled and passes at a speed of between 1.0 and 5.0 meters per minute through a thermo-resistant metallic tube alloy having an inside entrance diameter of 1.5 times the diameter of the substrate; and its exit diameter should be 10% less. For example, for a substrate having a diameter of 1.5 mm, the entrance should be 2.25 mm and its exit diameter of 2.025 mm (see FIG. 1). The metallic tube alloy, which is placed along the central axis of the pyrolysis chamber should be, at least, between 30% to 50% longer than the kiln's length. The thickness of the walls of the metallic tube should correspond to the diameter of the substrate. For example, for a substrate having 1.5 mm diameter the thickness of the wall of the metallic tube should vary from 12.0 mm at the entrance up to 13.125 mm at the exit; the diameter for a substrate of 5.0 mm diameter should be respectively and the thickness of its walls should vary from 30.0 mm at the entrance to 40.0 mm at the exit.

The metallic tube alloy retains along its complete length the temperature of 600° C.-1200° C. corresponding to the temperature of the furnace', which is substantially calibrated to the designed pulling velocity. The element in the production process should be pulled out manually or by a winding machine.

Going through the metallic tube alloy, the organic compound solution which saturates the substrate is vaporized, forming a gas-vapor atmospheric medium captured within the alloy.

The nature of the gas-vapor medium depends on the density of the hydrocarbon(s) solution compound, which is synchronized and controlled by using different carbon-based components and/or different concentrations. The resultant nano particles are at various sizes at <100 nm, derived from the hydrocarbon components.

This medium, captured within the tube alloy, does not evaporate but settles on the substrate. Therefore particles of this medium settle not only on the surface of the substrate but also on each of the quartz fiber filaments from which the substrate is made.

Due to the braiding structure of the quartz-sleeve, the obtained carbon-quartz product represents an analogue of a spiral system, i.e., a multi-wire electrical cable in which each of the cable's wires is analogous to each single fiber having a carbonaceous coating surface, which is connected through the bundle structure to the quartz polymer base.

The thickness of the compressed carbon coating is within the range of 0.08-0.8 μm in the form of graphite, bonded onto the substrate by a valence bond, orientated along the substrate with a formed orientation of a 10°-30° twist. The compressed carbon molecules, while being passed through the tube, take the form of "cell" molecules known as "fullerenes". Each single filament of the element is coated with a carbon tube and the entire carbon system is arranged in a helical system. The solid state structure of the carbon is crystalline. The element thus obtained is the desired current conductive element ("CCE").

In some embodiments owing to technical reasons the abovementioned carbon coating process is done in two production steps by utilizing a similar device that is made of two complementary units based on the same principle (see FIG. 2).

In the case that the carbon surface of the obtained CCE is still uneven and somewhat coarse it might periodically cause a mal-function of the CCE. In order to avoid such problems it is necessary to regulate the values of the mass of the carbon layer by smoothing its outer surface thereby improving its conductivity and resistance properties.

For example, in order to obtain a 2.020 mm CCE, the obtained CCE is pulled through an annular blade comprising a ring having a cutting edge formed on an internal edge of its exit aperture and having an adjustable exit aperture diameter equal to that of the proposed CCE. Thus, for a CCE of diameter 2.020 mm, the diameter of the exit aperture is 2.020 mm although it may be as large as 5.0 mm in some embodiments. Throughout the pulling-passing process, via the annular blade, the surface of the element is partially removed and its surface becomes even, smooth and mirror-like.

The polished mirror-like surface also extends the availability for using various technologies to coat the element(s) with a variety of thin metals for different uses as described herein.

As mentioned above, at this stage, the resulting carbon—quartz composite already has conductivity characteristics and can be used as a CCE for several uses such as a current-conducting element(s) for high-frequency cables, high voltage transmissions and other uses as described herein.

The conductivity and the resistance properties of the CCE depend on the thickness of the carbon layer, which is synchronized and controlled by six parameters:

i) The carbon-based components of the organic hydrocarbon solution(s).

ii) The relative concentration of the hydrocarbon solution(s).

iii) The diameter of the exit (hole) of the tube alloy.

iv) The speed of movement of the substrate through the furnace.

v) The temperature of the furnace/pyrolysis chamber.

vi) The exit size of the turning knife device.

Hereby are the basic physical, mechanical and electrical parameters of current-conducting elements having a Kevlar core of 1.0 mm:

| | |
|---|---|
| Armor yarns number: | 8 |
| Tensile Strength of the armored Kevlar yarn: | 200 cN/tex. |
| Filling fiber number: | 4 |
| Linear density: | 1.15 g/m |
| Fiber braiding density: | 7 fiber/Sq. meter. |
| Kevlar rope diameter (rated): | 1.0 mm. |
| Kevlar (1.0 mm core) - Quartz rope outside diameter: | 1.50 mm. |
| Strength - Breaking Point | 70-80N (7-8 kgf) |
| Elongation of a CCE at a total diameter of 1.5 mm: | 2%-3% |
| Melting point | at least 1,680° C; preferably 1,730° C. |
| Strength retention at 400° C. | 80%-90% |
| Thickness of the carbon coating (over each mono-filament fiber): | 0.08-3.0 micron |
| Orientation structure | graphite crystals |
| Orientation along forming fiber with a gag: | 10-30% |
| Minimum effective Carbon section for electrical resistant: | 0.025 mm. |
| Electric resistant to direct current (respectively): | 2-50 Ohm |
| Voltage Break down of alternating current of 50 Hz at water for 1 min. is: | 40 Ohm |
| Induced fading of a wire (e.g. 0.25 mm) at frequencies of 50, 100 and 150 MHz | not less than 32.62, i.e., 95 dB respectively. |
| Direct electrical current (Voltage) capacity of a 1.5 mm CCE: | 10,000 V |

It should be noted that the abovementioned parameters are not restrictive and may be considerably adjusted in other specific forms according to intended use, without departing from essential attributes thereof.

In some embodiments, the diameter of the Kevlar core element varies according to targeted uses, from 1.0 mm up to 4.0 mm. The larger the core's diameter, the larger is the resulting surface of the quartz substrate. Consequently the conductive elements will be correspondingly larger. Owing to the additional surface of the carbon in case of adding thickness to the carbon layer, its properties are upgraded. Upgraded CCEs, which have an improved conductivity, are mainly used for high-voltage long distance transmission cables and also for undersea water cables.

If a second carbon layer is required, it should be added using the same technology, process and furnace as detailed above but the size and the inner diameters of the thermo-resistant metallic cylindrical alloys should be adjusted as appropriate.

The second carbon layer could be formed, due to the high tensile strength properties of the CCE(s), either in a continuous process by adding to the production line a second furnace heated at 600° C.-1200° C. or by using the same furnace to repeat the same production process described above. The immersion basin should contain a boiling hydro-carbonaceous solution at a mass concentration of 3%-12% w/w. The solution comprises a hydrocarbon and in preferred embodiments hydrocarbons and carbonyls metal(s) at a concentration ratio of 10:1, and/or 10:5:1.

In either case, the thermo-resistant metallic alloy should be adjusted properly. At this second production stage the resulted CCE is pulled through the heated chamber at a velocity of between 1.0 to 5.0 meter/Min. so as to obtain the desired advantageous carbon layer.

The sequences of the process which takes place in the pyrolysis chamber are as follows.

The organic compounds during the pyrolysis are transformed to $C_2$ [org. compounds→[$C_2$] gas];

The $Fe(CO)_5$ ferrum carbonyl is transformed to activate carbon monoxide Fe+[*CO][$Fe(CO)_5$→Fe+[*CO]]4

$C_2$ connecting with CO set up carbon sub-oxide O═C═C═C═C═O.

CCEs produced according to the present invention do not undergo a polymerization process during use because of the structure of each of the carbon layers (one layer or two), which are made of fullerenes cages connected to the polymer base fibers by a mono-valent bond which is not amenable to being broken thus preventing polymerization. Consequently, their structure or properties never change and they retain their electro-conductivity.

The fullerenes formation of the carbon coating allows the preservation of initial electrical parameters of the electro-conductive element with no time limit, and also eliminates the most negative phenomena of carbon conductors, when used as vehicle ignition cables. For example, it extends active workability life time. The density of the high-frequency current is distributed across the cross-section of the cable in such a way that the current density, close to the core, tends to zero and due to the mirror-like smoothness property of the CCE surface, the conducting eddy currents are reduced almost to zero. Subsequently, noise frequencies are suppressed, giving rise to a substantial reduction of RF noise in the frequency range of 30-1000 MHz.

Metallization Process for Various Uses

It is of great industrial interest to coat the CCE with one metal layer, or with a combination of different metal groups such as: copper, aluminum, steel, palladium, platinum, silver, gold or any other metal in order to expand the range of use of the CCE thus obtained. The CCE's capacity to conduct electrical current substantially simplifies the process of applying metal coatings thereupon.

Unlike other current-conducting textile elements, the CCE according to the present invention, because of its high tensile strength, bending and abrasion strength properties may be coated in a continuous production process with a thin layer of copper, or aluminum, steel, palladium, platinum, silver, gold or any other metal or combination thereof, such that each metal layer is applied separately on to the CCE.

The process for impregnating metals upon the resulted conductive element can be done using well-known methods and technologies such as: electrolysis, gas-flame ("sputtering"), depositing from gas phase, electrophoresis or chemical, vacuum, laser, plasma, or diffusion processes.

The polished mirror-like property that has been given to the electro-conductive element facilitates the execution of an even, clear coating of any metal, by using, e.g., the well-known "Boulat" unit to execute a "sputtering" coating process.

The operation principle of the Boulat unit is based on blowing out ("sputtering") on to the CCE a part of the specific metal, which is placed at its storage plate unit. The depositing process of the metal particles upon the current-conducting quartz-carbon element occurs while the CCE is being conveyed through the heated Boulat storage plate.

Applying metal(s) upon the CCE(s) has been done by us successfully apart from the "Boulat" unit, by using other well-known technological methods according to industrial standards. Some examples will now be given:

Clear CCE samples (made according to the present invention) were impregnated with soft annealing electrolytic copper E-Cu58F21 according to Industrial Standard D/N40500.

By following standard D/N/SO 6722, Section 2, Class A, we obtained ignition cables having noise suppression properties.

In order to obtain useful catalysts for burning up different ICE exhaust gases, the CCE was impregnated with platinum, or palladium or rhodium according to Industrial Standard FRG D/N180380.

For other uses, metallization of a thin layer of copper or, tin, steel, silver, gold or any combination thereof is applicable. The obtained CCE is very economical and cost-effective.

In order to apply a combination of two different metals layers, or several layers of the same metal—each metal layer should be separately and successively coated on to the CCE, e.g., first metal No. 1; and then, secondly: metal No. 2, etc. By such means, a wide range of CCEs having various properties is provided.

Depending on existing technologies it is possible to produce CCEs according to the present invention having a resistance of 4-20 kΩ.

A CCE according to the present invention coated with one or more copper layers can be used as a standard electrical conductor for any voltage including domestic applications in the range: 110V-220V-360V.

Bearing in mind the current depletion of copper resources all over the world and the consequently escalating price, it appears highly relevant and economical to replace standard copper cables with cables according to the invention since the copper consumption to coat such a CCE is considerably lower than that required to produce a standard copper cable of comparable rating.

A CCE coated with a very thin layer of palladium may be used as a catalyst of exhaust gases in an internal combustion engine (ICE), due to its highly effective current rating. Taking into account the quantity of palladium required to impregnate the CCE with such a thin metal layer, which is negligible in comparison to standard catalysts, it is readily appreciated that such a cable is relatively inexpensive.

High-Voltage Transmission Cables

A cable having one CCE having a DC voltage rating of up to 10,000 V, with or without a metal coating, is suitable to be used in the electrical engineering industry for several uses as now specified.

A combined group of several Current-Conductive-Elements (wires), untwisted or twisted, gathered to a bunch, with or without a metal coating, may provide a current-conductive-element for high-voltage long distance transmission cables for various uses, e.g., a bunched group of 40 CCE wires, each CCE having a capacity of 10,000 V DC, can transmit 400 kV; a bunched group of 17 CCEs for transmission of 161 kV; a bunched group of 4 CCEs for transmission of 36 kV; and respectively for 22 kV and 13 kV.

The gathered CCEs should be insulation protected with an outer cover. For current uses in order to withstand temperatures in the range of −196° C. up to +1200° C. it should be protected by a cover of a quartz sleeve coated with polyethylene or, polypropylene, silicon; and/or with carbon composites of polyethylene, polypropylene or, silicon or with such polymers having similar qualities.

High-Voltage Cables with or without a metal coating produced according to the present invention, may be used in the following fields:

- Long Distance Super High-Voltage Transmission Lines.
- Long Distance High-Voltage Transmission Lines.
- Cables or wire harnesses for mounting electrical equipment in transport facilities (vehicles, satellites, aircrafts, vessels, etc.);
- Heating elements of clothes, carpets, heating facilities, warmers, mirrors, walls, ceilings, beddings;
- ICE high-frequency cables;
- Catalyst to burn up the ICE exhaust gases;
- For filtering liquids and gases;
- For producing medical materials;
- For producing construction materials for aircraft, rocket, vessel and vehicle industry.
- Fire-resistant materials and protective outwear suit fabric;
- Facilities for electromagnetic radiation protection;
- Products for protection against cuts;
- Compression packing gaskets.

In some embodiments having specific requirements, for example for deep submarine applications, a steel cable should be attached so as to strengthen the cable; and/or for additional protection, a corrugated aluminum sheath having a thickness of 2.25 cm should be attached.

The following examples No. 1-12, described below, were made in accordance with the physical, mechanical and electrical parameters of the current-conducting elements (CCEs) as tabulated below:

| | |
|---|---|
| Number of yarn of a Kevlar core (of 1.0 mm diameter) | 8 |
| Tensile Strength of each Kevlar yarn | 200 cN/tex. |
| Filling fiber number | 4 |
| Linear density | 1.15 g/m |
| Fiber braiding density | 7 fiber/Sq. meter. |
| Kevlar rope diameter | 1.0 mm. |
| Kevlar - Quartz rope outside diameter | 1.50 mm. |

-continued

| | |
|---|---|
| Strength - Breaking Point | 70-80N (7-8 kgf) |
| Elongation of a CCE at a total diameter of 1.5 mm | 2%-3% |
| Melting point | 1,680° C. |
| Strength retention at 400° C. | 80%-90% |
| Thickness of the carbon coating (over each mono-filament fiber) | 0.08-3.0 μm |
| Structure orientation | graphite crystals |
| Orientation along forming fiber with a gag - twisted | 10%-30% |
| Minimum effective Carbon section for electrical resistance | 0.025 mm. |
| Electric resistivity to direct current | 2-50 Ω · m |
| Voltage break down in water of alternating current of 50 Hz for 1 min | 40 Ohm |
| Induced fading of a wire (of, e.g. 0.25 mm) at frequencies of 50, 100 and 150 MHz | not less than 32.62, i.e., 95 dB respectively |
| Direct electrical current (Voltage) capacity of a 1.5 mm CCE | 10,000 V |

Example No. 1

A Kevlar rope, at a target diameter of 1.0 mm, made of 8 Kevlar yarns of 58.8 tex, having a tensile strength of at least 200 cN/tex each, was produced on a ShP-12-4 machine and was used as a core for braiding over it a sleeve-coat. The Quartz coat, made of quartz yarns of 17×4×1 (68 tex) was produced on a ShP-12-4 braiding machine.

The obtained Kevlar-quartz substrate of 1.5 mm was drawn at a velocity of 1.0 m/sec, through a basin, which contained a peat solution extracted in xylol, at a concentration of 3% w/w hydrocarbons per xylol. The immersed substrate was conveyed, via a tube alloy, situated in the mid-axis of the pyrolysis chamber, heated at 650° C., pulled manually at same velocity. The total added weight of the carbon mass over the core was predetermined at 10% w/w.

Example No. 2

A CCE made according to Example 1 above was coated with an additional carbon layer by drawing it at a velocity of 5.0 m/sec through a furnace heated at 1100° C., which contained a pyrolysis camber with an immersion basin, that contained a peat composite solution of carbon and hydro-carbonyls metal at a concentration ratio of 20:1, extracted in xylol, so its relative concentration of hydrocarbons per xylol was of 6% w/w. The immersed CCE was conveyed, via a properly adjusted tube alloy, which was situated in the mid-axis of the pyrolysis chamber.

The obtained CCE, with the double carbon layers, was pulled out by a winding machine at the same velocity. The final total added carbon mass weight was 15% w/w.

Example No. 3

CCEs that were prepared according to Examples 1 and 2 were exposed to a blowing process in a "Boulat" unit, heated at a 900° C., and were coated with platinum metal. The resulted catalyst was tested on VAZ-2106 car (A-76 petrol) by using a AFA-121 (focused at CO) and UG-2 (focused at carbon and hydrogen). Tests results indicated that the neutralization rate was 95% at 200° C.

Example No. 4

CCEs produced according to Examples 1 and 2 were coated with palladium (instead of platinum) as per Example 3. Neutralization rate due to tests results occurred at 200° C. to 98%.

Example No. 5

CCEs made according to Examples 1 and 2 were coated with rhodium as the metal in a similar manner to Example 3. Neutralization rate due to tests results was amounted at 200° C. to 97%.

Example No. 6

CCEs made according to Examples No. 1 and 2 were coated with Copper. The impregnation process was carried out by electrical blowing in vacuum method—a well-known method from the optoelectronics field.

Example No. 7

CCEs were prepared according to Examples No. 1 and 2. Coating of Aluminum (instead of platinum) was carried out according to Example No. 3.

Example No. 8

CCEs were made according to Examples No. 1 and 2. Coating of Steel (instead of platinum) was carried out according to Example No. 3.

Example No. 9

CCE was prepared according Examples No. 1 and 2. Coating of Palladium (instead of platinum) was carried out according to Example No. 3.

Example No. 10

CCEs were prepared according to said Example No. 1 and 2; coating of Platinum (instead of platinum) was carried out according to said Example No. 3.

Example No. 11

CCEs were according Examples No. 1 and 2. coating of Silver (instead of platinum) was carried out according to Example No. 3.

Example No. 12

CCEs prepared according Examples No. 1 and 2. Coating of Gold (instead of platinum) was carried out according to Example No. 3.

Example(s) No. 13

CCEs made as per each of Examples 1, 2, 3, 4, 5, 6, 7, 8, 9, 10, 11, 12 in the form of a bundle were insulation protected with an outer braided sleeve cover made of multilayer quartz fibers, by using quartz yarns of 17×4×1 (68 tex). The sleeves were braided on a ShP-12-4 machine having an adjusted exit.

Example No. 14

5 CCEs made as per each of Example 13, selected randomly, were insulation protected with an outer cover made of polyethylene carbon composite, manufactured by using routine industrial production procedure.

Example No. 15—for Test

10 CCEs manufactured according to PCT WO 01/47825 A1. The braided quartz sleeve was made of quartz fibers [17×4×1 (68 tex)]. The CCEs did not contain a Keviar longitudinal inner core or metallization.

The samples were produced for a comparison test as the control unit.

Example No. 16—for Test

10 CCEs manufactured according to RU 2145452. The braided quartz sleeve rope was made of quartz fibers [17×4×1 (68 tex)]. The CCE had no Keviar longitudinal inner core and no metallization.

The samples were produced for a comparison test as the control unit.

Tests Results

The tensile strength (TS), the bending strength (BS) and the abrasion resistance (AR) 3 samples of each of obtained CCEs, produced according to above Examples 1-8 were measured, in comparison to 3 samples made according to Example 15 of WO 01/47825 using the same equipment under identical conditions. All samples were randomly chosen.

The tensile strength (TS), the bending strength (BS) and the abrasion resistance (AR) of: 3 Cables produced according to Example No. 14, having CCEs made according to Example 1 (thus referred to herein as 14. 1*); and 3 having CCEs due to example 2 (referred to herein as 14. 2**) were also measured.

Data is set forth in Table No. 1, showing average results.

TABLE NO. 1

| Sample as per Example No. | Tensile Strength (TS) | Bending Strength (BS) | Abrasion Resistance (AR) |
|---|---|---|---|
| 1. | 8.7 | 1.5 | 1.7 |
| 2. | 8.6 | 1.3 | 1.7 |
| 3. | 8.7 | 1.5 | 1.8 |
| 4. | 8.7 | 1.4 | 1.9 |
| 5. | 8.7 | 1.6 | 1.7 |
| 6. | 8.7 | 1.5 | 1.7 |
| 7. | 8.7 | 1.5 | 1.7 |
| 15. | 1.0 | 1.0 | 1.0 |
| 16. | 1.0 | 1.0 | 1.0 |
| 14.1* | 8.6 | 1.3 | |
| 14.2** | 8.7 | 1.6 | |

Resistance Tests Results

The running resistance (Ohm/M) of 5 samples specified hereunder were measured.

QC (i.e., Quartz and Carbon without metal)—produced according to Example No. 1) were measured. The tests with each of these samples were repeated 10 times, at a cyclic change that varied from: −16° C. to +90° C. The measurements of Resistance were carried out using a SHCH301-2 device.

The average results are specified in Table No. 2:

TABLE NO. 2

| | Temperature, ° C. | | | | | | |
|---|---|---|---|---|---|---|---|
| | −16 | +23 | +30 | +40 | +50 | +60 | +90 |
| Resistance, Ohm/M | 13.68 | 13.36 | 13.32 | 1326 | 13.20 | 13.19 | 12.99 |

The running resistance (Ohm/M) of 5 samples specified hereunder were measured.

1. QC (i.e., Quartz and Carbon only)—produced according to Example No. 1)

2. QC-M (Quartz and Carbon with Metal)—made according to Example No. 3).

The tests with same samples were repeated 10 times, at a cyclic change that varied from: +15° C. to −196° C. [boiling temperature of liquid nitrogen]. The measurements of the Resistance were carried out by a SHCH301-2 device.

The average results are specified in Table No. 3:

TABLE NO. 3

| | | Test No | | | | | | | | | |
|---|---|---|---|---|---|---|---|---|---|---|---|
| Sample | T- ° C. | 1 | 2 | 3 | 4 | 5 | 6 | 7 | 8 | 9 | 10 |
| QC | +15° C. | 17.7 | 17.7 | 17.7 | 17.7 | 17.6 | 17.7 | 17.7 | 17.7 | 17.7 | 17.7 |
| QC | −196° C. | 21.5 | 21.6 | 21.5 | 21.7 | 21.6 | 21.6 | 21.5 | 21.6 | 21.6 | 21.6 |
| QC-M | +15° C. | 6.38 | 6.42 | 6.57 | 7.00 | 7.23 | 7.38 | 7.62 | 7.73 | 7.77 | 7.81 |
| QC-M | −196° C. | 11.2 | 11.6 | 11.8 | 11.9 | 12.0 | 12.2 | 12.3 | 12.4 | 12.5 | 12.5 |

The test results confirm that the QC Samples substantially maintained the electric properties at repeated cyclic changes of temperature.

The running resistance of samples QC-M was monotonously slightly changed as a result of influence of temperature differences.

Taking in account the basic properties of the raw materials of the cable and that the production process of the current-conductive textile element of the present invention includes a thermal treatment at 1200° C., the tests results above indicate that the CCE and the cable withstands temperature of −196° C. up to 1,680° C.

It should be evident to those skilled in the art that the invention is not limited to the details of the forgoing illustrative embodiments and examples and that the present invention may be embodied in other specific forms without departing from essential attributes thereof, and it is therefore desired that the present embodiments and examples be considered in all respects as illustrative and not restrictive, the scope of protection being determined solely by the appended claims.

What is claimed is:

1. An electric transmission cable having a current conductive element comprising a braided core formed of a plurality of high modulus synthetic armored yarns, each yarn being of at least 53.6 tex and having a tensile strength of at least 200 cN/tex (centiNewton/tex), and the core being of a diameter in the range of 0.7 mm to 4.5 mm and being surrounded by a quartz sleeve covered on an outer surface thereof by a carbon layer.

2. The electric transmission cable of claim 1, wherein the core is formed of a plurality of high modulus synthetic armored yarns such as Kevlar, Twaron, Nomex, Rusar or SHAM, each yarn of 58.8 tex having a tensile strength of at least 200 cN/tex (centiNewton/tex), and the core diameter being in a range of 1.0 mm to 4.5 mm.

3. The electric transmission cable of claim 2, wherein the core is covered with a braided sleeve cover, made of quartz yarns, each of 17×4×1 (68 tex), having a melting point of between 1,680° C. and 1,730° C.

4. The electric transmission cable of claim 3, wherein the braided quartz sleeve is coated with a carbon layer of thickness of between 0.08 micron and 3.0 micron, wherein each of the quartz filaments and the quartz sleeve-cover are covered by carbon particles of various sizes <100 nm. each filament of said quartz sleeve cover is coated with a thin deposit of carbon in the form of a tube, and the entire carbon layer is arranged in a spiral with a formed orientation of a 10°-30° twist; the structure of said carbon layer being arranged with an even number of deposited C60 molecules of carbon, the clusters of its atoms being higher than 32.

5. The electric transmission cable of claim 4, wherein the carbon layer is coated with a thin layer of metal forming a current conductive element.

6. The electric transmission cable of claim 5, wherein the current conductive element comprises one or more layers of any one of the following elements: copper or aluminum or palladium or rhodium or silver or gold or steel.

7. The electric transmission cable of claim 4, wherein the carbon-quartz composite conductive element has the following basic physical and mechanical parameters:

| | |
|---|---|
| Armor yarns number: | 8 |
| Tensile Strength of the armored Kevlar yarn: | 200 cN/tex. |
| Filling fiber number: | 4 |
| Linear density: | 1.15 g/m |
| Fiber braiding density: | 7 fiber/Sq. meter. |
| Kevlar rope diameter (rated): | 1.0 mm. |
| Kevlar (1.0 mm core) - Quartz rope outside diameter: | 1.50 mm. |
| Strength - Breaking Point | 70-80N (7-8 kgf) |
| Elongation of a CCE at a total diameter of 1.5 mm: | 2%-3% |
| Melting point | at least 1,680° C.; preferably 1,730° C. |
| Strength retention at 400° C. | 80%-90% |
| Thickness of the carbon coating (over each mono-filament fiber): | 0.08-3.0 micron |
| Orientation structure | graphite crystals |
| Orientation along forming fiber with a gag: | 10-30% |
| Minimum effective Carbon section for electrical resistant: | 0.025 mm. |
| Electric resistant to direct current (respectively): | 2-50 Ohm |
| Voltage Break down of alternating current of 50 Hz at water for 1 min. is: | 40 Ohm |
| Induced fading of a wire (e.g. 0.25 mm) at frequencies of 50, 100 and 150 MHz | not less than 32.62, i.e., 95 dB respectively. |
| Direct electrical current (Voltage) capacity of a 1.5 mm CCE: | 10,000 V. |

8. The electric transmission cable of claim 4, wherein the carbon layer is protected by a protection cover which is made of a braided quartz sleeve and/or of polyethylene, or polypropylene, or silicon; or a carbon-polyethylene composite, a carbon-silicon composite, or a carbon-polypropylene composite respectively to temperatures ranged from: −196° C. to +1200° C.

9. The electric transmission cable of claim 8, being a single electric cable having a capacity of 10,000 V DC.

10. The electric transmission cable of claim 9, having capacities for industrial uses of 0.001 V-24 V; and of 115 V-220 V-360 V.

11. An electric transmission cable comprising a bunched group of cables according to claim 9.

12. The electric transmission cable of claim 11, comprising 40 cables according to claim 9 suitable for a long distance transmission of 400 kW; a bunched group of 17 cables for 161 kV; a bunched group of 4 cables for a long distance transmission of 36 kV; 3 single cables for 22 kV and 2 cables for 13 kV.

13. The electric transmission cable of claim 11 further being covered with a corrugated aluminum sheath of thickness of 2.25 nom.

14. The electric transmission cable of claim 11 further comprising a steel reinforcement cable along its length.

15. The electric transmission cable of claim 9 comprising a current-conductive-element of textile Kevlar-Quartz-Carbon composite formed of a central core, braided of synthetic high modulus Kevlar or comparable yarns, surrounded by a braided quartz cover coated with a carbonaceous current-conductive element that is adapted to withstand extreme temperatures in a range between −196° C. and +1200° C. and being protected-isolated with an outer sleeve cover.

* * * * *